US010392237B2

(12) United States Patent
Reimer

(10) Patent No.: US 10,392,237 B2
(45) Date of Patent: Aug. 27, 2019

(54) CHAIN TENSIONING ARRANGEMENT AS WELL AS PUMP STATION

(71) Applicant: XYLEM IP MANAGEMENT S.À R.L., Senningerberg (LU)

(72) Inventor: Jens Reimer, Täby (SE)

(73) Assignee: XYLEM EUROPE GMBH (CH)

( * ) Notice: Subject to any disclaimer, the term of this patent is extended or adjusted under 35 U.S.C. 154(b) by 142 days.

(21) Appl. No.: 15/516,242

(22) PCT Filed: Sep. 28, 2015

(86) PCT No.: PCT/IB2015/057421

§ 371 (c)(1),
(2) Date: Mar. 31, 2017

(87) PCT Pub. No.: WO2016/051327

PCT Pub. Date: Apr. 7, 2016

(65) Prior Publication Data

US 2018/0229984 A1 Aug. 16, 2018

(30) Foreign Application Priority Data

Oct. 2, 2014 (SE) ..... 1451168
Mar. 31, 2015 (SE) ..... 1550380

(51) Int. Cl.
*E21B 41/00* (2006.01)
*B66D 5/16* (2006.01)
(Continued)

(52) U.S. Cl.
CPC ..... *B66D 5/16* (2013.01); *F04D 13/086* (2013.01); *F04D 29/607* (2013.01); *B66D 1/36* (2013.01);
(Continued)

(58) Field of Classification Search
CPC .... E21B 41/00; E21B 41/0007; E21B 43/128; B66D 5/16; F04D 13/086; F04D 29/607
See application file for complete search history.

(56) References Cited

U.S. PATENT DOCUMENTS 3,369,715 A * 2/1968 Carter ..... F04D 9/00 222/333
3,938,545 A * 2/1976 Nagy ..... E02D 29/14 137/363
(Continued)

FOREIGN PATENT DOCUMENTS

DE 10301524 A1 * 7/2004 ..... B66C 1/38
GB 2382561 A * 6/2003 ..... B66C 1/38
(Continued)

OTHER PUBLICATIONS

International Search Report and Written Opinion for International Application No. PCT/IB2015/057421, dated Dec. 16, 2015, 9 pages.
(Continued)

*Primary Examiner* — Matthew R Buck
(74) *Attorney, Agent, or Firm* — RatnerPrestia

(57) ABSTRACT

A chain tensioning arrangement for a column pipe which is configured to house a submersible pump. The chain tensioning arrangement includes a radially extending cross beam, a spring arrangement connected to the cross beam, at least one spring member, and an arm that is movably connected to the cross beam. The arm includes an engagement member configured to optionally engage a chain connected to the pump. The arm is displaceable in the axial direction between a lower position and an upper position. The spring member is arranged to displace the arm in the direction from the lower position towards the upper position. Also described is a pump station including a column pipe, a submersible pump arranged in the column pipe and an axially extending chain
(Continued)

connected to the pump and configured to move the pump in the column pipe.

15 Claims, 16 Drawing Sheets

(51) Int. Cl.

| | |
|---|---|
| ***F04D 13/08*** | (2006.01) |
| ***F04D 29/60*** | (2006.01) |
| *B66D 1/36* | (2006.01) |
| *F04C 13/00* | (2006.01) |
| *F04D 29/64* | (2006.01) |

(52) U.S. Cl.
CPC ..... *B66D 2700/02* (2013.01); *B66D 2700/03* (2013.01); *F04C 13/008* (2013.01); *F04D 29/648* (2013.01)

(56) References Cited

U.S. PATENT DOCUMENTS

| | | | | |
|---|---|---|---|---|
| 4,080,106 | A | 3/1978 | Haesloop | |
| 4,435,132 | A | 3/1984 | Haesloop et al. | |
| 4,676,311 | A * | 6/1987 | Dysarz | F04B 47/02 166/68.5 |
| 5,522,631 | A * | 6/1996 | Halonen | B66C 1/34 294/66.1 |
| 6,386,487 | B1 * | 5/2002 | Owesson | H02G 1/10 166/377 |
| 6,425,339 | B1 * | 7/2002 | Furlong | B63B 21/18 114/200 |

FOREIGN PATENT DOCUMENTS

| | | | | |
|---|---|---|---|---|
| JP | 59106000 | A * | 6/1984 | F04D 29/607 |
| JP | 2004196525 | A | 7/2004 | |

OTHER PUBLICATIONS

International Preliminary Report on Patentability for Internationl Application No. PCT/IB2015/057421, dated Dec. 23, 2016, 7 pages.
Written Opinion of the International Preliminary Examining Authority for International Application No. PCT/IB2015/057421, dated Aug. 26, 2016.

* cited by examiner

CHAIN TENSIONING ARRANGEMENT AS WELL AS PUMP STATION

CROSS-REFERENCE TO RELATED APPLICATIONS

This patent application is a U.S. National Phase Patent Application of PCT Application No. PCT/IB2015/057421, filed Sep. 28, 2015, which claims priority to Swedish Patent Application Nos. 1550380-8, filed Mar. 31, 2015 and 1451168-7, filed Oct. 2, 2014, all of which are incorporated by reference herein in their entirety.

TECHNICAL FIELD OF THE INVENTION

The present invention relates in general to a chain tensioning arrangement for a column pipe. The present invention relates especially to chain tensioning arrangement for an axially extending column pipe which is configured to house a submersible pump, the chain tensioning arrangement comprising a cross beam configured to extend in the radial direction in relation to the column pipe. According to a second aspect the present invention relates to a pump station comprising an axially extending column pipe, a submersible pump arranged in the column pipe, a chain tensioning arrangement comprising a cross beam extending in the radial direction in relation to the column pipe, and an axially extending chain connected to the pump and configured to move the pump in the column pipe.

BACKGROUND OF THE INVENTION AND PRIOR ART

In some types of liquid handling, for instance transport of large volumes of lightly contaminated water such as surface water, a submersible pump in the form of an axial pump present a number of advantages. Axial pumps are arranged lowered into column pipes and are typically electrically driven wherein the power supply to the pump is effected via one or more cables that extend down to the pump via the inside of the column pipe.

Thus, the pump is normally intended to be placed in a column pipe that is partly lowered into the pumped media. Before start up the axial pump is lowered into the column pipe until it stands on a bottom flange in the column pipe and thereby seals tightly against the column pipe. Consequently the pump is entirely or partly submersed into the media when it has reached its operational position. During operation the column pipe also work as an outlet pipe for the pumped liquid. Before service the pump is hoisted and removed from the column pipe.

Lowering as well as hoisting of the pump is normally performed by means of a winch device such as a fixed or mobile crane comprising a strong chain having a hook in the lower end thereof. The hook is configured to hitch a lifting handle of the pump. Axial/vertical transportation of the pump through the column pipe is allowed when the hook is in engagement with the lifting handle.

When the axial pump occupies the operational position it is necessary according to prior art to unhook the hook from the lifting handle and entirely remove the chain from the column pipe. This is done in order to avoid that the strong liquid currents that always arise in the column pipe during the operation of the axial pump would bring the chain in violent motions. Such an uncontrolled rotating oscillatory motion of the chain would unavoidably damage the electric cables that extend from the pump and up inside the column pipe to the upper end thereof. It shall be mentioned that the electric cables are attached to and axially displaceable along a stretched wire extending from the pump and to the upper end of the column pipe. If the electric cables would not be attached to the wire they would be brought in a rotating oscillatory motion and be damaged against the inner surface of the column pipe.

However, the abovementioned known methods including removal of the chain before operating the pump suffer from at least one considerable drawback. More precisely, there is no easy way of hitch the previously unhooked hook of the chain on the lifting handle of the pump before a coming hoisting of the pump. In this context, an arduous and time consuming method to hitch the hook on the lifting handle is to lower the open hook to an appropriate vertical level and thereafter try to hitch the open hook in the lifting handle of the pump. In an alternative method a guide wire may be used that extend from the ground level (upper end of the column pipe), under the lifting handle of the pump and back to ground level. Before hoisting of the pump the guide wire can be connected to the hook of the chain and thereafter the hook can be lowered and the hook may fairly well be controlled to a right position for hitching the lifting handle.

OBJECT OF THE INVENTION

The present invention aims at obviating the aforementioned disadvantages and failings of previously known solutions by providing a chain tensioning arrangement. A primary object of the present invention is to provide a chain tensioning arrangement of the initially defined type, which chain tensioning arrangement result in that the chain does not need to be removed from the column pipe since the chain tensioning arrangement effectively reduces, and at the best entirely prevents, oscillations of the chain and the damaging effect these oscillations would have had to the electric cables.

An object of the invention related to the above is that the reduction/elimination of the oscillations of the chain is performed in a controlled and controllable way.

Another object of the present invention is to provide a chain tensioning arrangement, which admit permanent removal of the stretched wire that the electric cables are attached to according to prior art solutions.

It is another object of the present invention to provide a chain tensioning arrangement, that during lowering as well as hoisting of the pump admit retake, i.e. a temporarily pause during lowering/hoisting of the pump in order to for instance adjust the position at which the crane seize the chain, when the lifting height of the crane is less than the vertical length of the column pipe.

SUMMARY OF THE INVENTION

According to the invention at least the primary object is attained by means of the initially defined chain tensioning arrangement and the pump station, having the features defined in the independent claims. Preferred embodiments of the present invention are further defined in the dependent claims.

According to a first aspect of the present invention there is provided a chain tensioning arrangement of the initially defined type, and according to a second aspect of the present invention there is provided a pump station, wherein the chain tensioning arrangement is characterized in that it comprises a spring arrangement connected to the cross beam and comprising at least one spring member, and an arm that is movably connected to the cross beam and that comprises an engagement member configured to optionally engage a chain connected to said pump, wherein the arm has a main extension configured to extend in the radial direction in relation to the column pipe, the arm being displaceable in the axial direction between a lower position and an upper position, said at least one spring member being arranged to displace the arm in the direction from the lower position towards the upper position.

Thus, the present invention is based on the insight that when the engagement member of the arm is in engagement with the chain, the oscillations of the chain is reduced by means of a displacement of the arm in the direction from the lower position towards the upper position, i.e. towards the open end of the column pipe, the chain is tightened and stretched.

Thereto, a tightened and essentially immovable chain provides the possibility to attach the electric cables to the chain and consequently a need for a dedicated wire therefor can be avoided.

Thereto, the use of the chain tensioning arrangement also makes it possible to hold the pump at a reached vertical position inside the column pipe during retake. The chain tensioning arrangement can support the entire weight of the hanging pump when the engagement member of the arm is in engagement with the chain.

According to a preferred embodiment the chain tensioning arrangement also comprises means for to an adjustable extent limit the displacement of the arm by means of said at least one spring member. It is realized that an adjustable control of the extent of the displacement renders it possible to adapt it in a controlled way. More precisely, hereby the extent of the displacement can be adjusted in order to exactly match the slack of the chain, i.e. the displacement continues preferably until a completely stretched chain is obtained.

According to a preferred embodiment of the present invention the arm is pivotable in a radially extending plane between an active position and an inactive position. The chain tensioning arrangement has in this embodiment a pivotable arm, the engagement member thereof being in engagement with the chain, when the arm is in the active position. The chain tensioning arrangement according to this embodiment is especially suitable for use during a retake.

According to another preferred embodiment said at least one spring member is constituted by a helical spring. A simple technical solution is hereby obtained. Thereto, the use of a helical spring entail, when using a plurality of spring members, that these members easily can be arranged in such a way, for instance connected in series, that the total spring action increase in proportion to the number of spring members.

According to another preferred embodiment the means for to an adjustable extent limit the displacement of the arm by means of said at least one spring member is constituted by a screw. Hereby a reliable and robust solution is obtained that during long time and without deteriorated functionality can manage the harsh environment inside the column pipe. The screw is manipulated by means of any suitable tool.

According to an alternative preferred embodiment the position of the lower end of said at least one spring member can be adjustable in the axial direction. Hereby a simple alternative way of adjusting the extent of the displacement of the arm is obtained. Displacement of the lower end of the spring member can for instance be made by means of a suitable screw.

Further advantages with and features of the invention will be apparent from the other dependent claims as well as from the following detailed description of preferred embodiments.

FURTHER ELUCIDATION OF PRIOR ART

Document JP 2004/196525 disclose a chain tensioning arrangement configured to be used in a pump station comprising an axially extending column pipe and a submersible pump arranged in said column pipe. The chain tensioning arrangement comprises a cross beam configured to extend in the radial direction in relation to the column pipe, wherein an axially extending chain is connected to the cross beam and to the pump and is configured to move the pump in the column pipe.

Document U.S. Pat. No. 6,386,487 disclose a wire and electric cable stretching arrangement to be used in an axially extending column pipe, wherein the stretching arrangement comprises a spring arrangement.

BRIEF DESCRIPTION OF THE DRAWINGS

A more complete understanding of the abovementioned and other features and advantages of the present invention will be apparent from the following detailed description of preferred embodiments in conjunction with the appended drawings, wherein.

DETAILED DESCRIPTION OF PREFERRED EMBODIMENTS

The present invention relates especially to a chain tensioning arrangement configured to be used in a column pipe that is configured to house a submersible pump.

Figure 1:
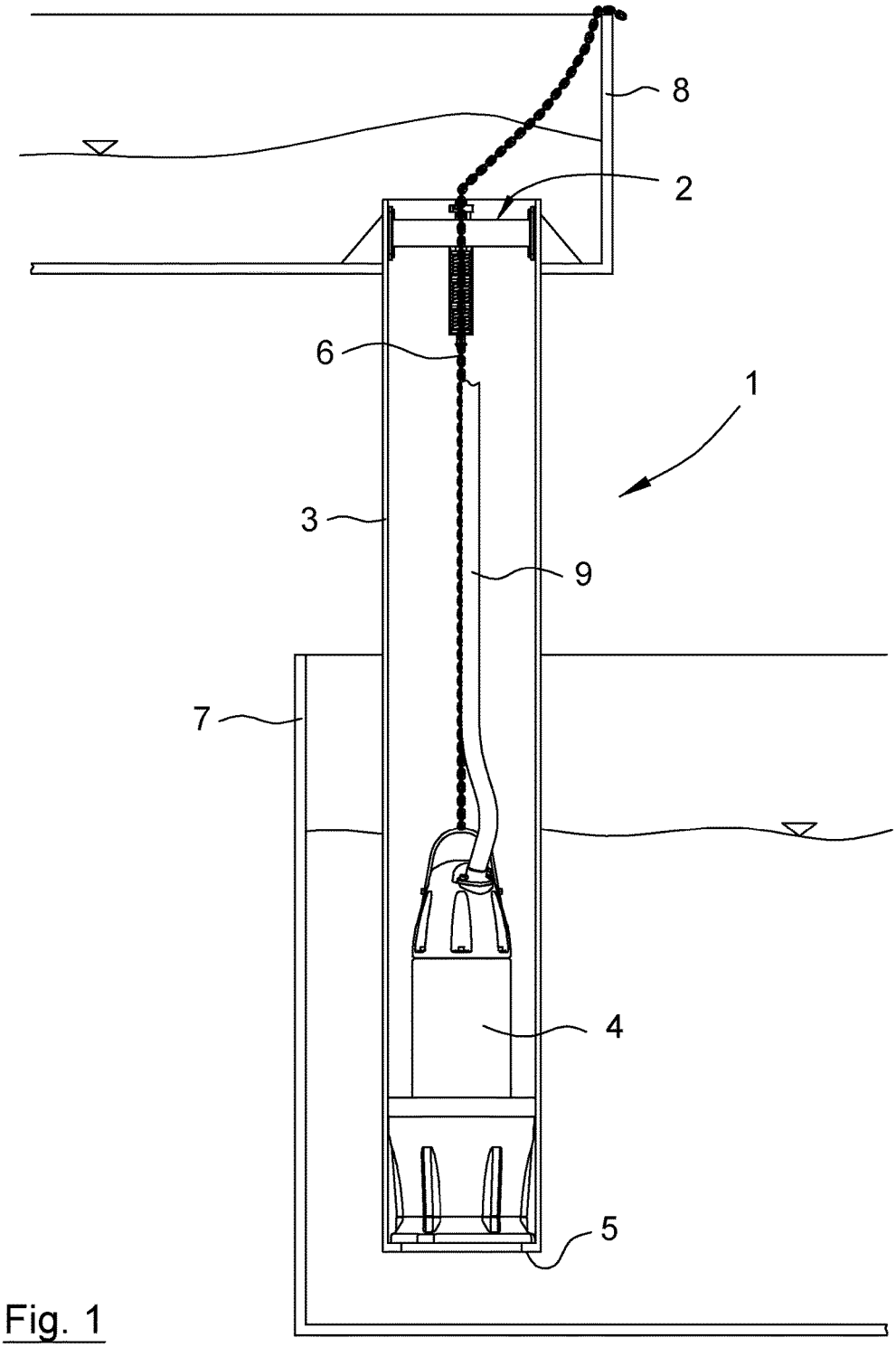
FIG. 1 is a schematic cut-away front view of an installation comprising an inventive pump station having a chain tensioning arrangement.

Reference is initially made to FIG. 1 that is a schematic cut-away front view of an installation of a pump station, generally designated 1.

The pump station 1 comprises a chain tensioning arrangement, generally designated 2, that is arranged in the area of the upper end of a column pipe 3 that house a submersible pump 4. The submersible pump 4 is in the disclosed embodiment constituted by an axial pump that has a weight in the range 1-1.5 tons, however it shall be pointed out that there are axial pumps that weigh a few hundred kilogram as well as other axial pumps that weigh several tons. The column pipe 3 is open in both ends, and is typically 4-8 meters long and usually has a diameter in the range 0.5-1 meters even thus other dimensions may exist. The disclosed submersible pump 4 stand on a bottom flange 5 in the column pipe 3 and is in tight connection with the column pipe 3. A chain 6 that is part of a winch device (not shown) is connected to the pump 4. The column pipe 3 establish a fluid path between a lower basin 7 that is filled with a medium to be pumped and an upper basin 8 that is meant to receive the pumped medium. The pumped medium may for instance be constituted by surface water, lightly contaminated waste water, etc. The chain tensioning arrangement 2 is arranged inside the column pipe 3, more precisely adjacent to the upper end of the column pipe in order to admit manipulation thereof. The different components and operational principles of the chain tensioning arrangement 2 will be described herein below in more detail and with reference to FIGS. 2-5, which disclose a first embodiment of the present invention, and to FIGS. 6-9, which disclose a second embodiment of the present invention, wherein the second embodiment is more general. It shall be pointed out that the chain tensioning arrangement 2 not necessary has to be arranged inside the column pipe 3, it can be arranged straight above the column pipe 3, i.e. in connection with the upper basin 8. It shall also be pointed out that the chain tensioning arrangement 2 may also be arranged in other pump stations/basins and is not limited to be used in connection with a column pipe 3. In an alternative, not shown, embodiment the pump station comprises a basin (i.e. a liquid holding unit equivalent to the column pipe) that house the submersible pump. A chain is connected to the pump and the pump is connected in a suitable way to the outlet pipe (i.e. an outgoing fluid connection equivalent to the column pipe).

Figure 2A:
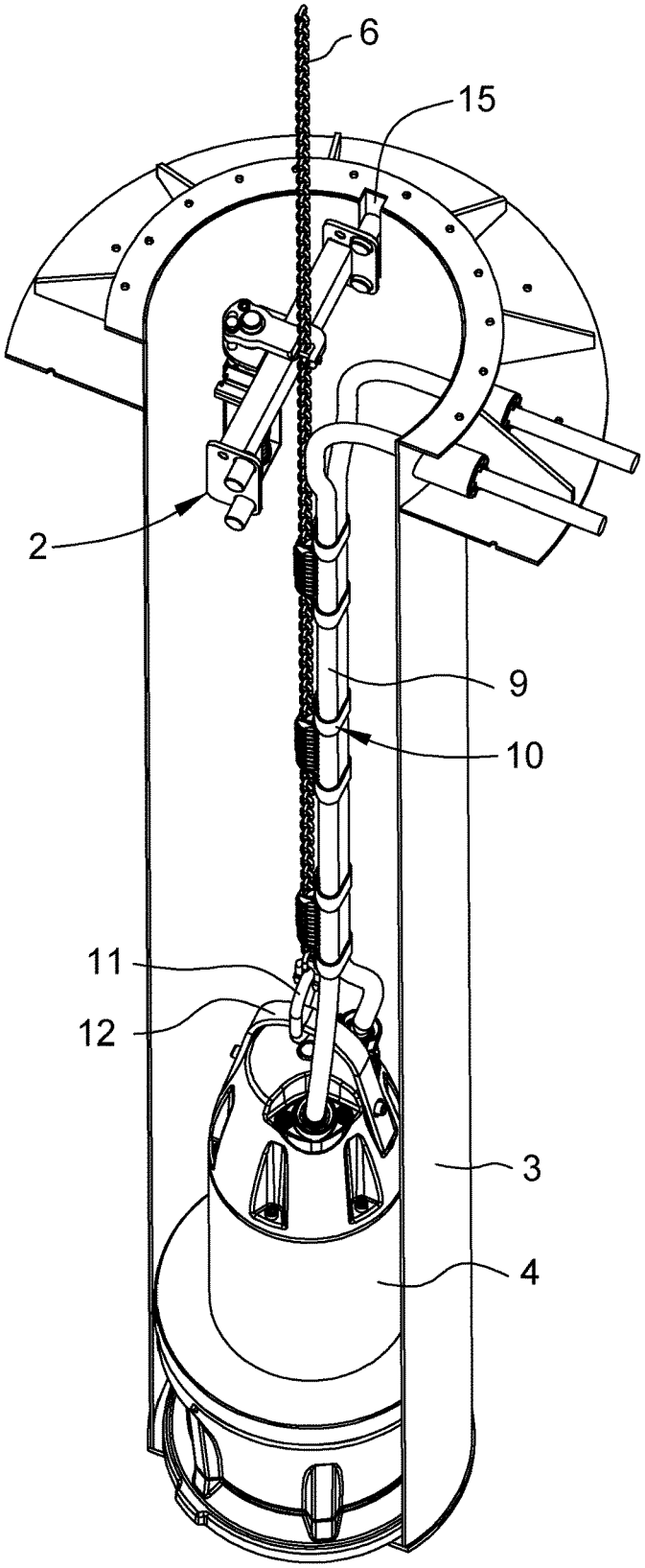
FIG. 2*a* is a schematic perspective view from above of a fully operational pump station comprising an inventive chain tensioning arrangement according to a first embodiment, the column pipe disclosed partly transparent.
Figure 2B:
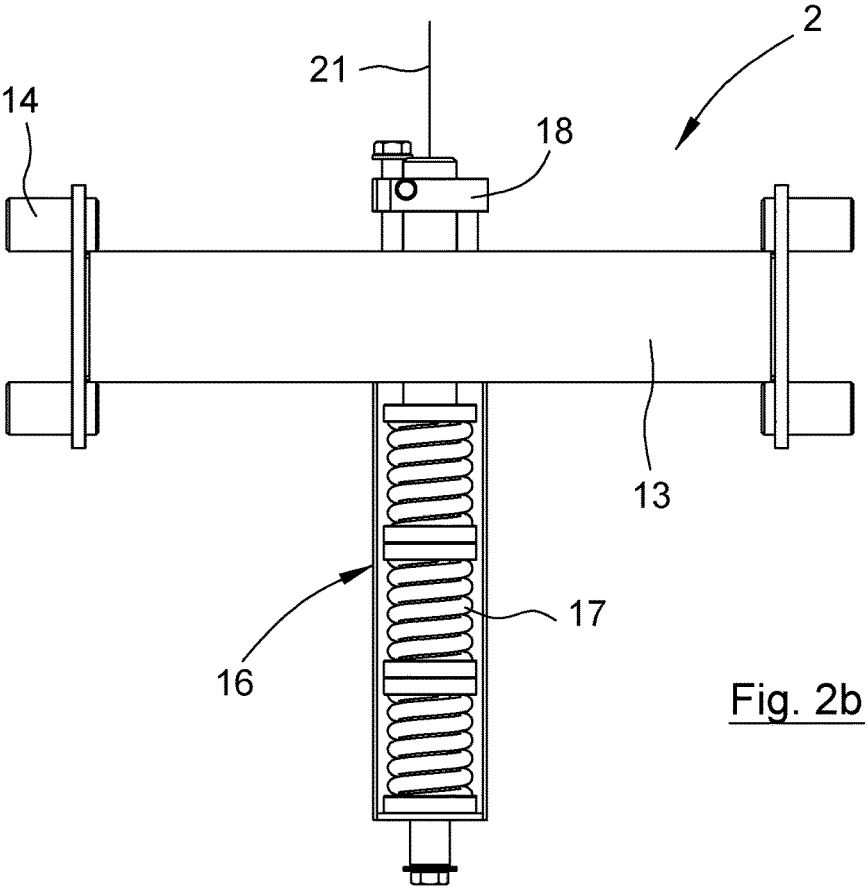
FIG. 2*b* is a schematic front view of only the chain tensioning arrangement according to the first embodiment in which it is fully operational in accordance with FIG. 2*a*.
Figure 2C:
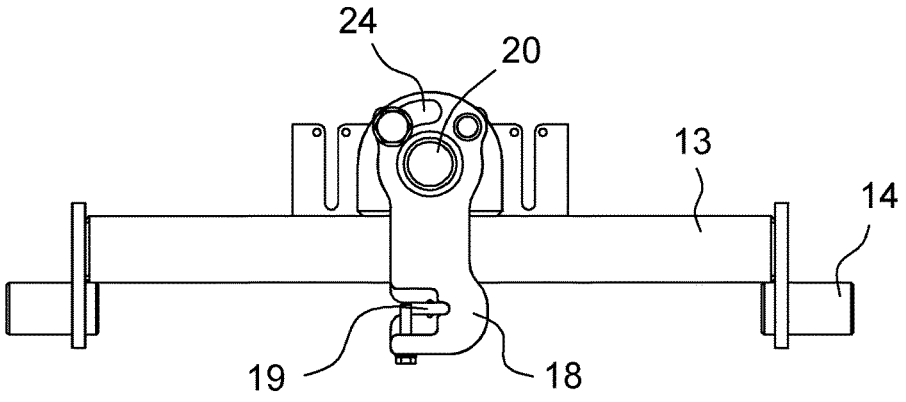
FIG. 2*c* is a schematic view from above of the chain tensioning arrangement according to the first embodiment in which it is fully operational in accordance with FIG. 2*b*.

Reference is now made to FIGS. 2*a*-2*c*, in which FIG. 2*a* is a schematic perspective view from above of a pump station 1 comprising a chain tensioning arrangement 2 installed in the column pipe 3 and having an axial pump 4 located at the bottom of the column pipe 3, wherein the chain 6 is stretched by means of the chain tensioning arrangement 2. In the disclosed embodiment the pump 4 is ready to take in operation in order to pump the medium in the direction upwards in the figures. Two electric cables 9 extend from the pump 4 to the upper end of the column pipe 3 and further to a control cabinet or the like. The electric cables 9 are connected to the chain 6 by means of a plurality of two part electric cable holder, generally designated 10, which will be described in more detail herein below with reference to FIGS. 11*a* and 11*b*. A hook 11, or lifting eye, is arranged in the lower end of the chain 6 and is in engagement with a lifting handle 12 of the pump 4.

The chain tensioning arrangement 2 comprises a cross beam 13 extending in the radial direction and that in the disclosed embodiment comprises at least one pin 14 in the respective opposite end thereof, the pins 14 being configured to be detachably connected to corresponding seats 15 in the column pipe 3. In the disclosed embodiments the cross beam 13 is horizontally arranged. According to an alternative, not disclosed, embodiment the cross beam is only connected to (in engagement with) the column pipe 3 in one end and projects like a console from the inner wall of the column pipe 3. According to yet another, not disclosed, embodiment the cross beam comprises three or more beam segments that, in the shape of a star, are connected to each other and connected to (in engagement with) the column pipe.

Thereto the chain tensioning arrangement 2 comprises a spring arrangement 16 that is connected to the cross beam 13 and that comprises at least one spring member 17. The chain tensioning arrangement 2 also comprises an arm 18 that is movably connected to the cross beam 13 and that comprises an engagement member 19 configured to optionally be in engagement with the chain 6. The arm 18 is displaceable in the axial direction between a lower position, adjacent the cross beam 13, and an upper position, axially remote from the cross beam.

Said at least one spring member 17 is arranged to displace the arm 18 in the direction from the lower position towards the upper position, e.g. upwards in FIGS. 2*a*-2*c*. Each such displacement of the arm 18, when the engagement member 19 of the arm 18 is in engagement with the chain 6, result in that the chain 6 is tensioned and stretched such that the slack become less or is entirely eliminated. Thereby the chain 6 is prevented from rotation/oscillating in the column pipe 3 since the freedom of movement of the stretched chain is greatly limited compared to the freedom of movement of a slack chain. Thereby, also the damaging effects of these oscillations to the electric cables 9 and the column pipe 3 are consequently reduced/eliminated.

In this way the basic object is attained, e.g. remove the need to remove the chain 6 from the column pipe 3 before pump operation at the same time as the electric cables 9 are kept undamaged. Of course this also entail that reattachment of the hook at the lifting handle of the pump is no more needed. Considerable time losses and trouble in connection with service can thereby be avoided by means of the inventive chain tensioning arrangement.

The chain tensioning arrangement according to the first embodiment thereto comprises means for to an adjustable extent limit the displacement of the arm 18 in the axial direction by means of said at least one spring member 17. Said means will be described in more detail herein below with reference to FIGS. 5*a* and 5*b*.

The different components of the chain tensioning arrangement are disclosed from the front in FIG. 2*b* and from above in FIG. 2*c*. In FIGS. 2*b* and 2*c* the chain tensioning arrangement 2 is removed from the column pipe and the chain, but remains in operational position.

Thus, FIG. 2*b* discloses among other things the spring arrangement 16 that in the disclosed embodiment comprises three spring members 17. The spring members 17 are constituted by helical springs. This solution is simple to scale since it allow serial connection between the individual helical spring members. During operation the arm 18 is located between the lower end position and the upper end position and the spring member 17 is thus partly released, i.e. neither fully compressed nor entirely expanded. According to an alternative, not discloses, embodiment the spring arrangement 16 comprises leaf springs, cup springs, etc. It is central for the spring arrangement 16 that a comparative short stroke is needed and high spring constant. In the disclosed embodiment the stroke is in the range 5-10 centimeters. The spring member 17 shall be dimensioned to stretch the chain 6 but not be able to lift the pump 4.

Reference is now made to FIG. 2*c* that among other things disclose the arm 18 that is, as mentioned above, movably connected to the cross beam 13 by being axially displaceable in relation to the cross beam 13. The arm 18 is in the disclosed embodiment in one end connected to the spring arrangement 16, more precisely to a rod 20 that is part of the spring arrangement 16 and in the free end the arm 18 disclose above mentioned engagement member 19, which will be described in more detail with reference to FIG. 5*a*. The rod 20 is displaceable in the axial direction together with the arm 18.

The arm 18 has a radial main extension and is preferably pivotable in a radially extending plane about a turning axis 21 running together with centre axis of the rod 20. The disclosed cross beam 13 extends in parallel with the plane in which the arm 18 is pivotable. In FIG. 2*c* the arm 18 is shown pivoted to an active position in which the engagement member 19 is in engagement with the chain (removed). Analogously, the arm 18 is in an inactive position when the engagement member 19 is pivoted away from the position disclosed in FIG. 2*c*. The arm 18 via the rod 20 is connected to the spring member 17. Alternatively a direct connection between the arm 18 and the spring member 17 can be realized.

In the following and with reference to FIG. 2*a* the function of the chain tensioning arrangement 2 according to the first embodiment is described in connection with installation of the pump 4 in the column pipe 3 as well as activation of the pump 4.

The pump 4 is lowered from ground level by means of the chain 6 and is arranged such that it is tight against the bottom flange 5 of the column pipe 3. When the pump 4 stands on the bottom flange the chain 6 is slack. The chain tensioning arrangement 2 is now attached to the upper end of the column pipe 3, and it is secured that the arm 18 is located in its lower position, abutting the cross beam 13 or located in close connection to the cross beam 13. The chain 6 is stretched/lifted by hand and is maximally tensioned. The chain link that best match the position of the arm 18 in the height direction is brought into the engagement member 19. The arm 18 is allowed to be displaced towards the upper position under the action of the spring member 17. The extent of the displacement is in the magnitude 5 centimeters. Thus, the chain 6 is tensioned and stretched such that its slack is considerably less or entirely eliminated. The pump is now ready for operation.

Figure 3A:
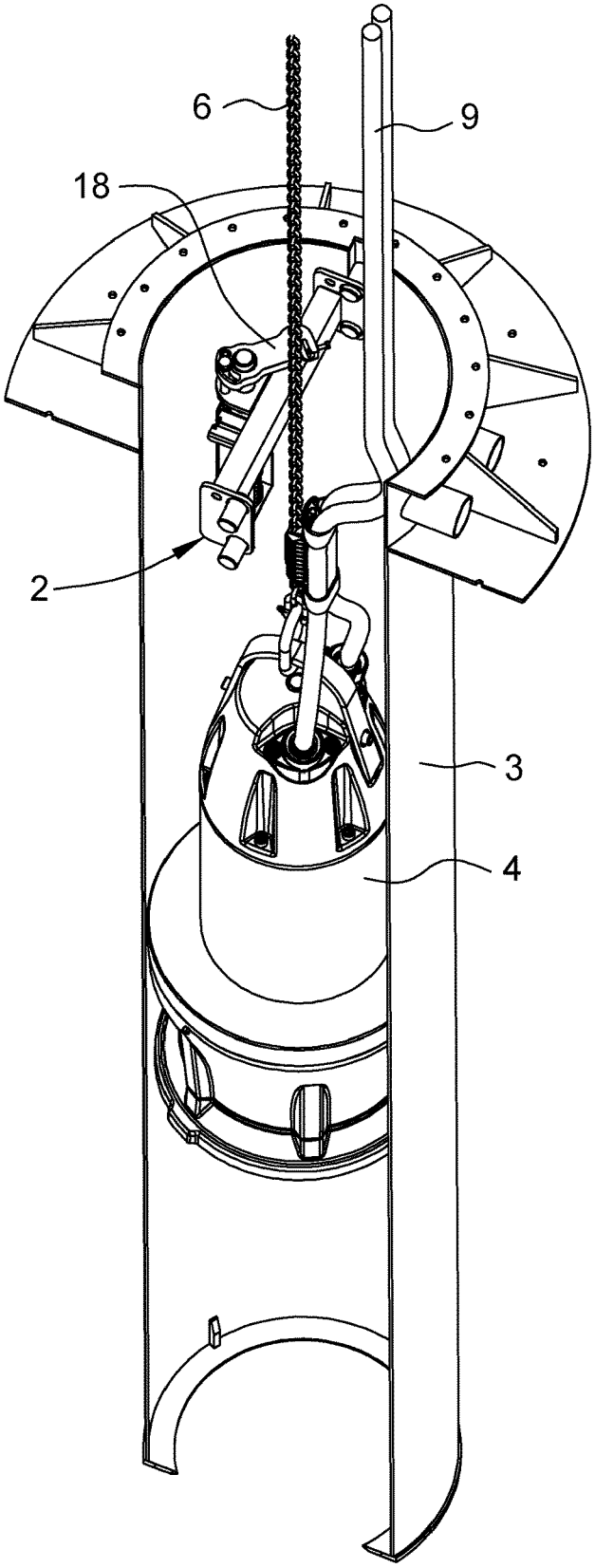
FIG. 3*a* is a schematic perspective view from above of a pump station in which the pump is hoisted/lowered, the column pipe is disclosed partly transparent.

Reference is now made to FIG. 3*a* that is a schematic perspective view from above of the pump station 1 during the pump 4 being hoisted or lowered. Parts/functions that are like the embodiments according to FIGS. 2*a*-2*c* are not referred to. Thus, the pump 4 is not in operation but is hoisted or lowered in the column pipe 3 by means of a suitable winch device. The chain tensioning arrangement 2 must not be detached from the walls of the column pipe 3 during hoisting/lowering. However, the engagement member 19 of the arm 18 must be unengaged from the links of the chain 6, e.g. the arm 18 ought to be located in its inactive position. This is accomplished as is shown in FIG. 3*a* by pivoting the arm 18 away from the chain 6.

Figure 3B:
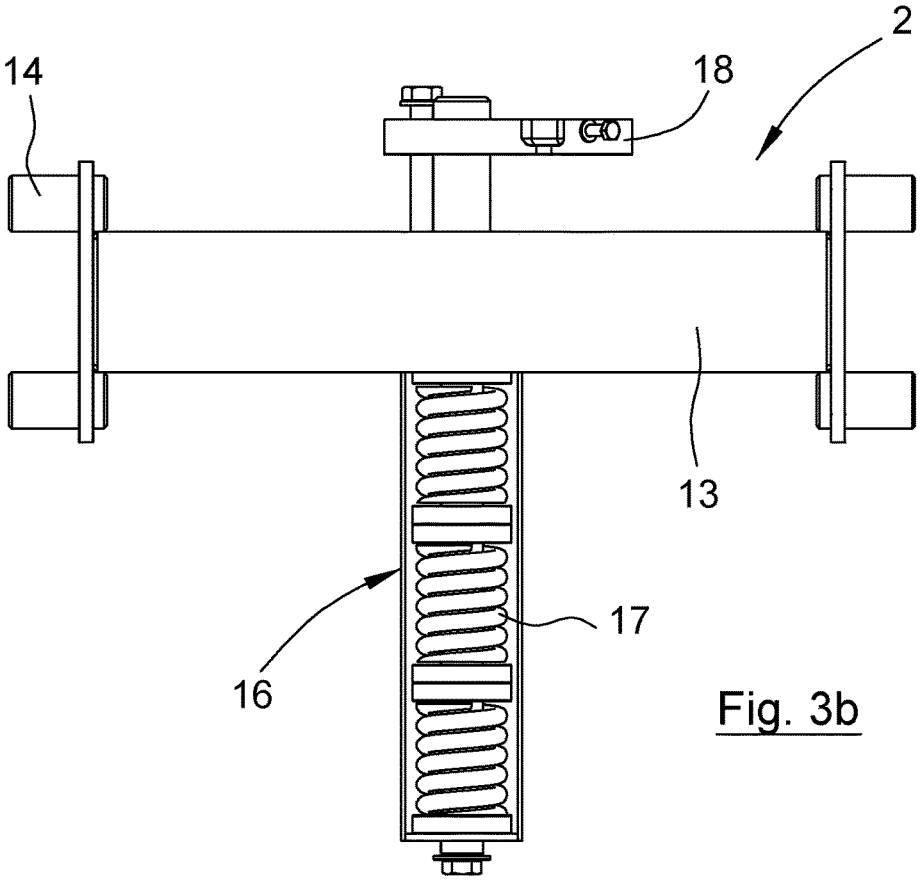
FIG. 3*b* is a schematic front view of only the chain tensioning arrangement according to the first embodiment in which the pump is hoisted/lowered in accordance with FIG. 3*a*.
Figure 3C:
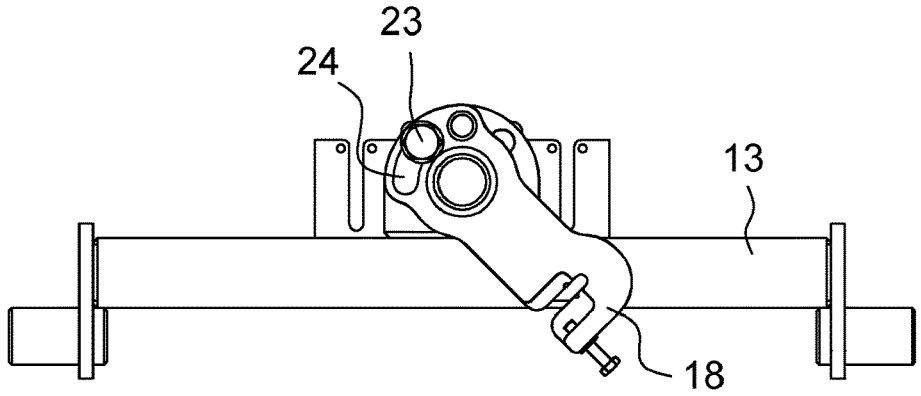
FIG. 3*c* is a schematic view from above of the chain tensioning arrangement according to the first embodiment in which the pump is hoisted/lowered in accordance with FIG. 3*b*.

Analogously to FIGS. 2*a* and 2*b* the different components of the chain tensioning arrangement 2 are disclosed from the front in FIG. 3*b* and from above in FIG. 3*c*. By comparing the spring arrangement of FIGS. 2*b* and 3*b* it is clear that the spring member 17 in FIG. 3*b* is maximally extended. Thus, the arm 18 that is connected to the spring member 17 is located in the upper position. The spring arrangement exerts no upwardly directed force against the arm 18, that thereby can be pivoted between its active and inactive positions, respectively.

In the following and with reference to FIG. 3*a* the function of the chain tensioning arrangement is described in connection with hoisting of the pump 4 from the bottom of the column pipe 3 to the top of the column pipe 3 and/or our of the column pipe 3.

The arm 18 is displaced in the direction towards the lower position by having the spring member 17 compressed, whereby the chain 6 is slacked and can be unengaged from the arm 18. The arm 18 is allowed to be displaced to the upper position and is thereafter pivoted away from the active position to the inactive (disclosed) position and thereby allows the pump 4 to be hoisted in a conventional way by lifting the chain 6. Before the pump 4 can be removed from the column pipe 3 the chain tensioning arrangement 2 must be removed from the upper end of the column pipe 3. In an alternative embodiment, in which the arm 18 is not pivotable, the chain tensioning arrangement is removed directly after the engagement between the arm 18 and the chain 6 is broken and the chain is slack, and before the pump 4 is started to be lifted by means of the chain.

Figure 4A:
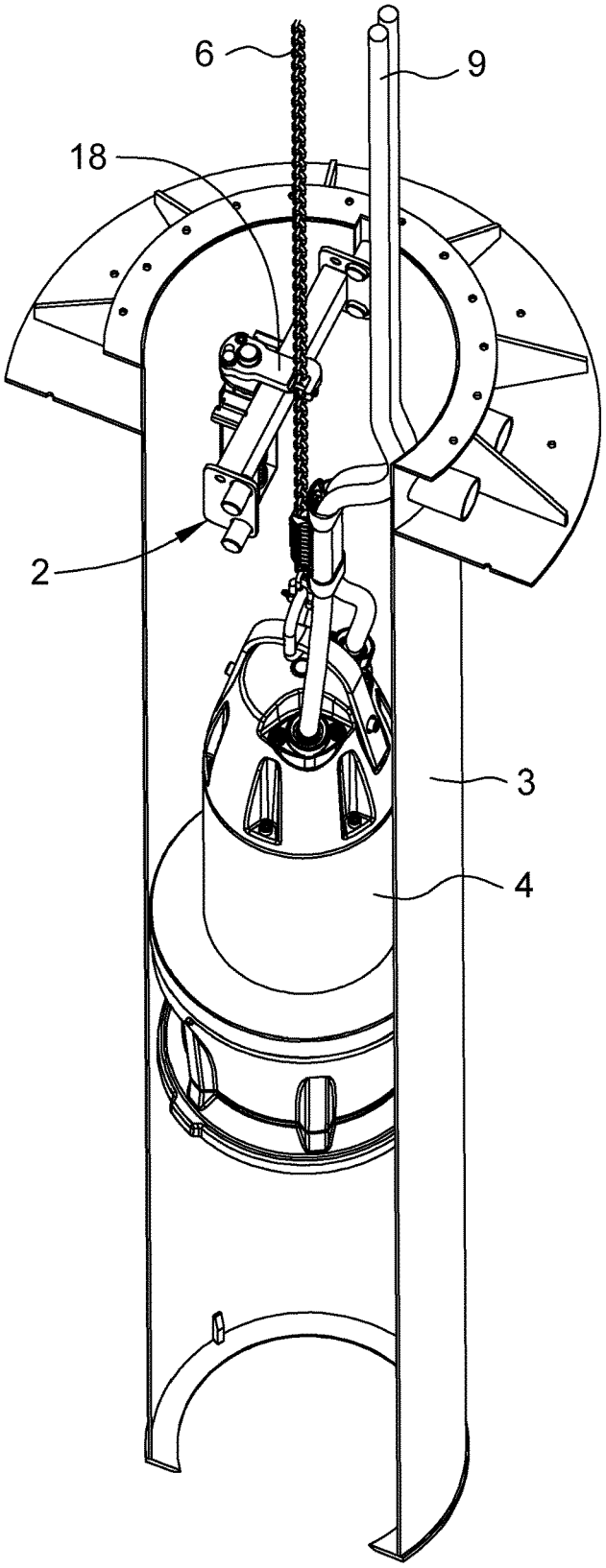
FIG. 4*a* is a schematic perspective view from above of a pump station in which the chain and the axial pump is under retake, the column pipe is disclosed partly transparent.

Reference is now made to FIG. 4*a* that is a schematic perspective view from above of a pump station in an installation wherein so-called retake is needed. Once again, parts/functions that are like the embodiments according to FIGS. 2*a*-2*c* and 3*a*-3*c*, respectively, are not referred to.

As has been mentioned above sometimes the situation/installation, for instance when the maximum lifting height of the crane is less than the length of the column pipe, demand for the hoisting or lowering of the pump 4 is divided into several stages and a retake is needed between these stages. In such situations the chain tensioning arrangement is preferably used to secure and remain the pump 4 at the reached height in the column pipe 3 during the retake operation.

In the following and with reference to FIG. 4*a* the function of the chain tensioning arrangement is described in connection with retake during hoisting of the pump 4. Since the pump 4 in the bottom of the column pipe 3 up to now has been in operation the starting situation is that the chain 6 is stretched, the arm 18 is in engagement with the chain 6 and is displaced in the direction towards the upper position during the action of the spring member 17.

During hoisting the arm 18 is displaced towards the lower position and the chain 6 starts to slack. The chain 6 is removed from the engagement member 19 of the arm 18. The arm 18 is thereafter moved to the upper position and is pivoted to the inactive position. The pump 4 is hoisted to a height admitted by the crane, the chain is thus tensioned since the pump 4 is now hanging in the chain 6 and the chain run centrally in the column pipe 3. The arm 18 is in the upper position and is pivoted from the inactive position towards the active position towards the chain 6 such that the engagement member 19 engage the chain link that best match the height of the position of the arm 18. The pump 4 is thereafter lowered a few centimeters by means of the crane such that the entire weight of the pump 4 is supported by the chain tensioning arrangement 2. Thus, the arm 18 is forced to the lower position in which the arm 18 abut the cross beam 13. Thereafter the crane takes a new grip in the chain 6 close to the chain tensioning arrangement. The pump 4 is lifted a few centimeters such that the arm 18 comes to the upper position. The arm 18 is pivoted to the inactive position such that the engagement between the engagement member 19 and the chain 6 is broken. The chain tensioning arrangement 2 is removed from the column pipe 3 such that the pump 4 may be hoisted all the way up to the top of the column pipe 3 and/or out of the column pipe 3. Alternatively one or more extra retakes can be needed.

The function of the chain tensioning arrangement in connection with retake during lowering of the pump 4 is analogous with the above described procedure regarding hoisting with retake.

Thus, the pump 4 is firstly lowered as much as the crane admit except from at least the few centimeters the pump 4 is needed to be lowered when the arm 18 is displaced to the lower position by the weight of the pump 4. The chain 6 that runs centrally in the column pipe 3 is tensioned since it is loaded with the entire weight of the pump 4. The chain tensioning arrangement 2 is attached having the arm 18 pivoted to the inactive position as well as in the upper position. The arm 18 is pivoted to the active position such that the engagement member 19 may engage the chain 6. The pump 4 is lowered a few centimeters by means of the crane such that the weight of the pump is supported by the arm 18 and the chain tensioning arrangement 2 when the arm 18 abuts the cross beam 13. The crane takes a new grip higher up on the chain and lifts the pump a few centimeters such that the arm 18 is displaced to the upper position by means of the spring member 17 and then once again is pivoted to the inactive position. The pump 4 is thereafter lowered all the way down to the bottom of the column pipe 3 and the chain 6 becomes slack. Alternatively one or more extra retakes may be needed. The rest of the procedure is constituted by tensioning of the slack chain 6 as is already described in connection with FIGS. 2*a*-2*c*.

Figure 4B:
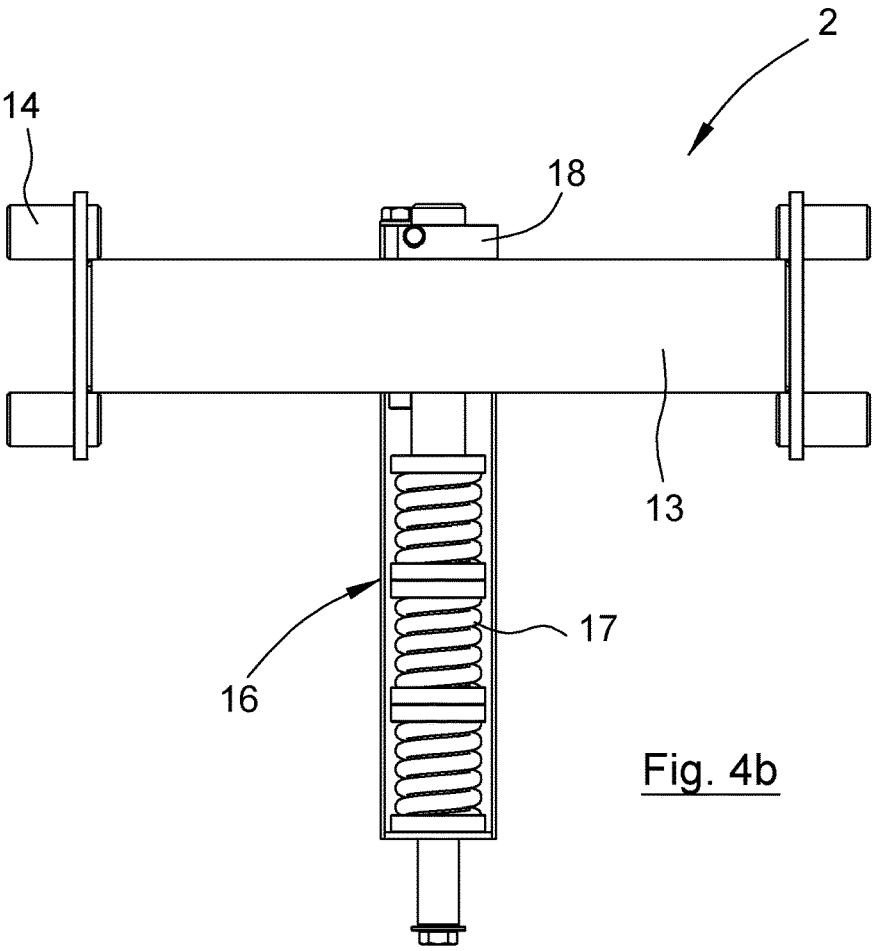
FIG. 4*b* is a schematic front view of only the chain tensioning arrangement according to the first embodiment in which the pump is under retake in accordance with FIG. 4*a*.
Figure 4C:
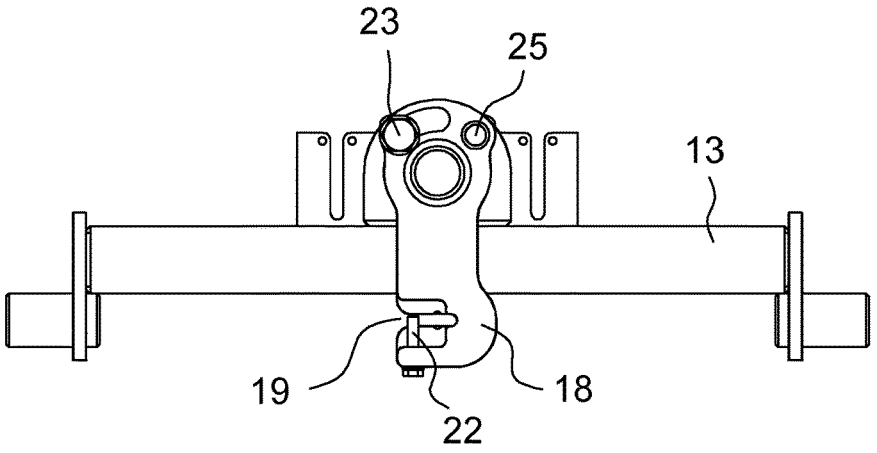
FIG. 4*c* is a schematic view from above of the chain tensioning arrangement according to the first embodiment in which the pump is under retake in accordance with FIG. 4*b*.

Analogously with FIGS. 2*b* and 3*b*, and FIGS. 2*c* and 3*c*, respectively, the components of the chain tensioning arrangement are disclosed from the front in FIG. 4*b* and from above in FIG. 4*c*, respectively. By comparing the spring arrangement in FIGS. 2*b* and 3*b* it is clear that the spring arrangement in FIG. 4*b* is maximally compressed. It is due to the pump 4 hanging in the chain tensioning arrangement and thus the entire weight of the pump is supported by the chain tensioning arrangement. Thus, the arm 18 that is connected to the spring member of the spring arrangement is in the lower position abutting the cross beam 13. The spring arrangement shall preferably not bottom when the arm 18 is located in the lower position.

In the following reference is made to FIG. 5*a* that is an perspective view from above of the front side of the chain tensioning arrangement according to the first embodiment as well as FIG. 5*b* that is a perspective view from above of the back side of the chain tensioning arrangement according to the first embodiment in accordance with FIG. 5*a*. Parts/functions that are like the embodiments according to FIG. 2-4 are not referred to in detail.

Figure 5A:
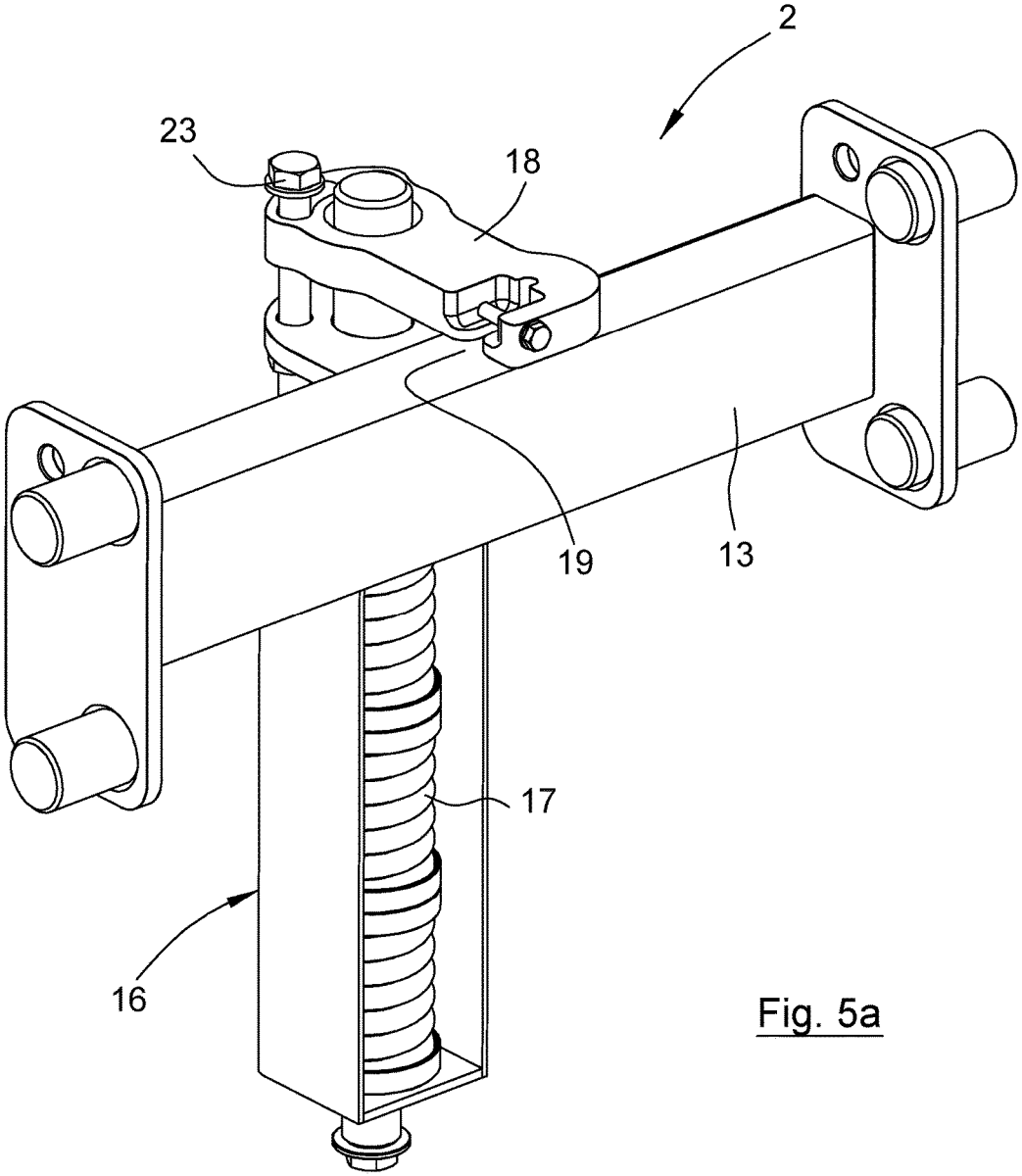
FIG. 5*a* is a perspective view from above of a chain tensioning arrangement according to the first embodiment in which it is operational in accordance with FIGS. 2*b* and 2*c*.
Figure 5B:
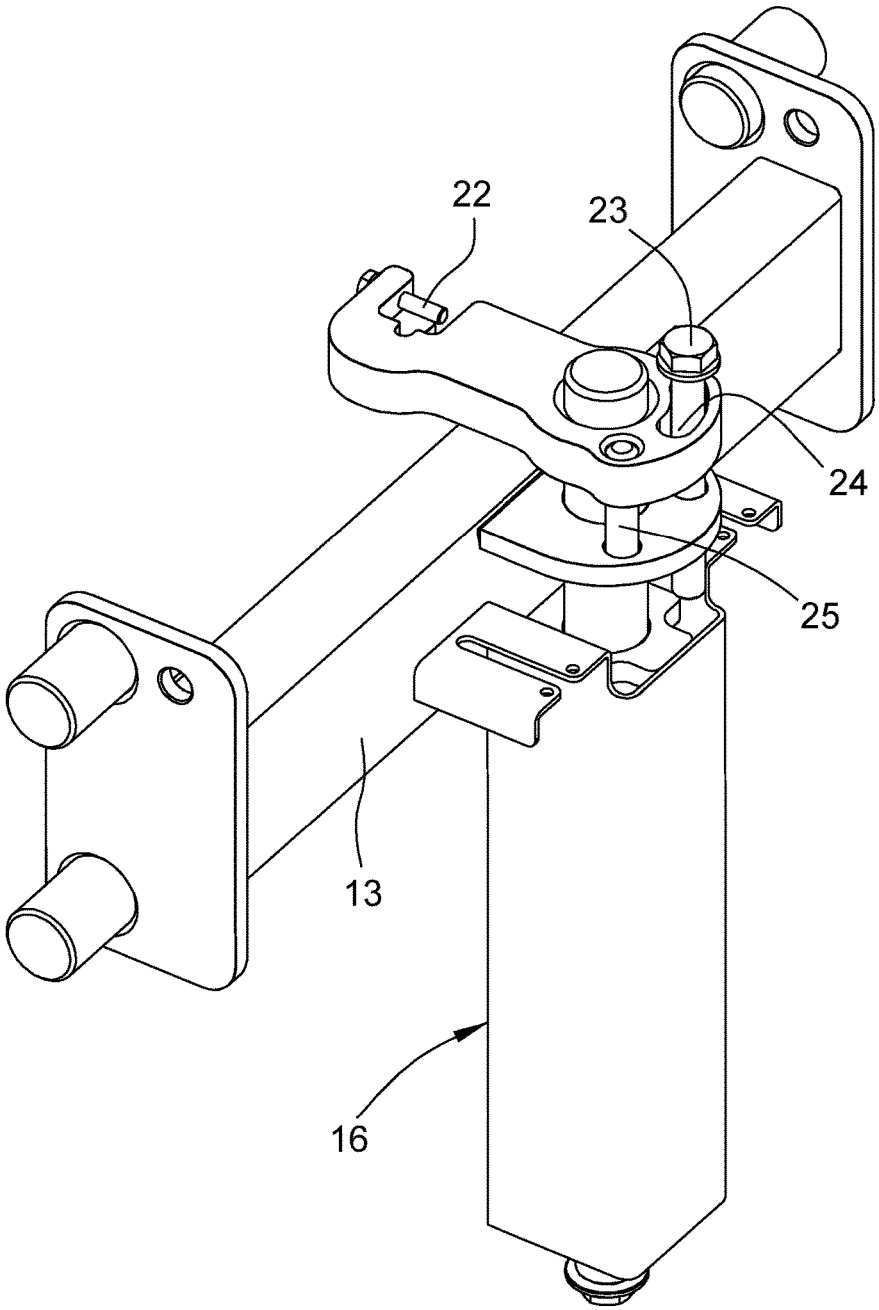
FIG. 5*b* is a perspective view from above of the back side of the chain tensioning arrangement according to the first embodiment in which it is operational in accordance with FIG. 5*a*.

FIGS. 5*a* and 5*b* disclose among other things the cross beam 13 having the pins 14 arranged in the opposite ends of the cross beam. Thereto the spring arrangement 16 having three spring members 17 that are constituted by helical springs is disclosed. In the figures the helical springs are partly compressed—the chain tensioning arrangement is in the stage in which the pump is in operation and the chain tensioning arrangement stretches the chain. The arm is in the active position and is displaced in the direction from the lower position towards the upper position.

In the free end the arm 18 has the engagement member 19. The engagement member 19 has a seat configured to receive at least one link of the chain 6. A locking pin/locking screw 22 attends to secure the received chain link in the seat. In the disclosed embodiments the seat is arranged perpendicular to the direction of the main extension of the arm, however other angles are conceivable, such as parallel to the direction of the main extension of the arm.

The chain tensioning arrangement according to the first embodiment thereto comprises means for to an adjustable extent limit the displacement of the arm 18 by means of said at least one spring member 17. In the disclosed embodiment the means is constituted by a screw 23 that can be manipulated in the axial direction and that is manipulated by means of a suitable tool. In an alternative, not disclosed, embodiment the lower end of said at least one spring member 17 may be adjustable/displaceable in the axial direction. Thereby, an alternative solution to adjust the magnitude of the load on the spring member 17 is obtained.

The chain tensioning arrangement 2 can be realized without the above mentioned screw 23. According to yet another, not disclosed, embodiment the screw 23 may be exchanged by a adjustable clamp that upon activation force the arm 18 from the upper position towards the lower position.

As previously mentioned the arm 18 is pivotable about a pivot axis in a radially extending plane. An arc-shaped groove 24 is arranged in the arm 18 and the screw 23 that can be manipulated in the axial direction is located in said groove 24. Their joint action delimits the pivot angle of the arm 18.

FIG. 5*b* also discloses a guide pin 25. The purpose of the guide pin 25 is to prevent pivoting of the arm 18 when it is located in the lower position or in a position remote from the upper position.

Herein below the second, more general, embodiment according to FIGS. 6-9 is disclosed. Only differenced in relation to the first embodiment will be described, and it shall be realized that features and functions of the first embodiment is directly applicable to the second embodiment, and vice versa, if nothing else is stated.

The most essential difference between the first embodiment and the second embodiment of the chain tensioning arrangement 2 is that the latter lacks means for to an adjustable extent limit the displacement of the arm 18 by means of said at least one spring member, and this partly affects the function of the chain tensioning arrangement 2.

In the following and with reference to FIGS. 6*a* and 6*b* the function of the chain tensioning arrangement 2 according to the second embodiment is described in connection with installation of the pump 4 in the column pipe 3 as well as the activation of the pump 4.

The pump 4 is lowered from ground level by means of the chain 6 and is arranged such that it is tight against the bottom flange 5 of the column pipe 3. When the pump 4 stands on the bottom flange the chain 6 is slack. The chain tensioning arrangement 2 is attached to the upper end of the column pipe 3, and it is controlled/secured that the arm 18 is in the upper position. The chain 6 is stretched/lifted by hand and is maximally tensioned. The chain link that is located at the same height as the upper side of the cross beam is observed/marked and a suitable chain link located between the observed/marked chain link and the chain link that is at the same height as the engagement member 19 is chosen as engagement chain link. It is secured that the arm 18 is pivoted to the inactive position. The pump 4 is lifted in the chain 6 until the engagement chain link is at the same height as the engagement member 19. The arm 18 is pivoted to the active position and the engagement chain link is allowed to engage the engagement member 19. Thereafter, the pump 4 is lowered such that it once again is tight against the bottom flange 5 of the column pipe 3. The arm 18 is displaced towards the lower position and the spring member 17 is compressed due to the engagement between the arm 18 and the chain 6. The extent of the displacement is in the magnitude 5 centimeters. It shall be made clear that the arm 18 is located at a distance from the cross beam 13 when the pump 4 stands on the bottom flange 5. Thus, the chain 6 is now stretched such that its slack is considerably less or entirely eliminated. The pump is ready for operation.

Figure 7A:
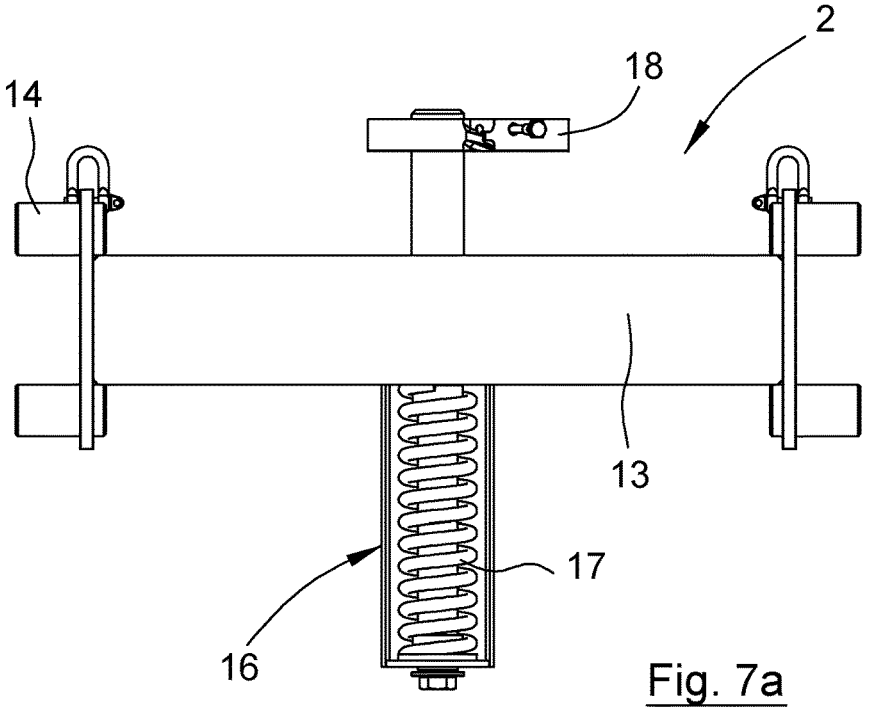
FIG. 7*a* is a schematic front view of the chain tensioning arrangement according to the second embodiment in which the pump is hoisted/lowered in accordance with FIG. 3*b*.
Figure 7B:
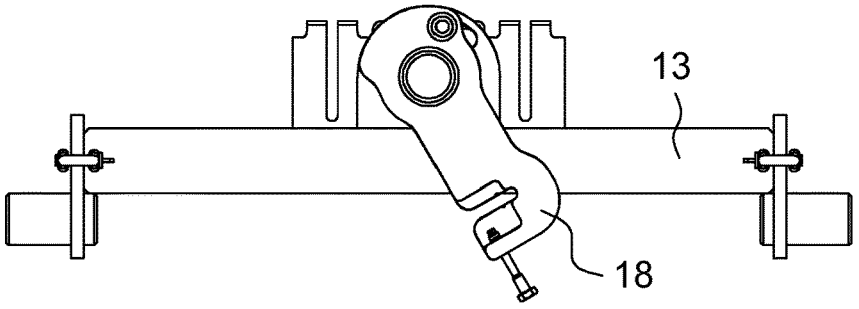
FIG. 7*b* is a schematic view from above of the chain tensioning arrangement according to the second embodiment in which the pump is hoisted/lowered in accordance with FIG. 7*a*.

Reference is now made to FIGS. 7*a* and 7*b* that disclose the chain tensioning arrangement 2 according to the second embodiment during hoisting or lowering of the pump 4. Thus, the pump 4 is not operating but is hoisted or lowered in the column pipe 3 by means of a suitable winch device. The chain tensioning arrangement 2 must not be removed from the walls of the column pipe 3 during hoisting/lowering. However, the engagement member 19 of the arm 18 must be unengaged from the engagement chain link, i.e. the arm 18 should preferably be set in the inactive position. This is performed, as is disclosed in FIGS. 7*a* and 7*b*, by pivoting the arm 18.

Figure 6A:
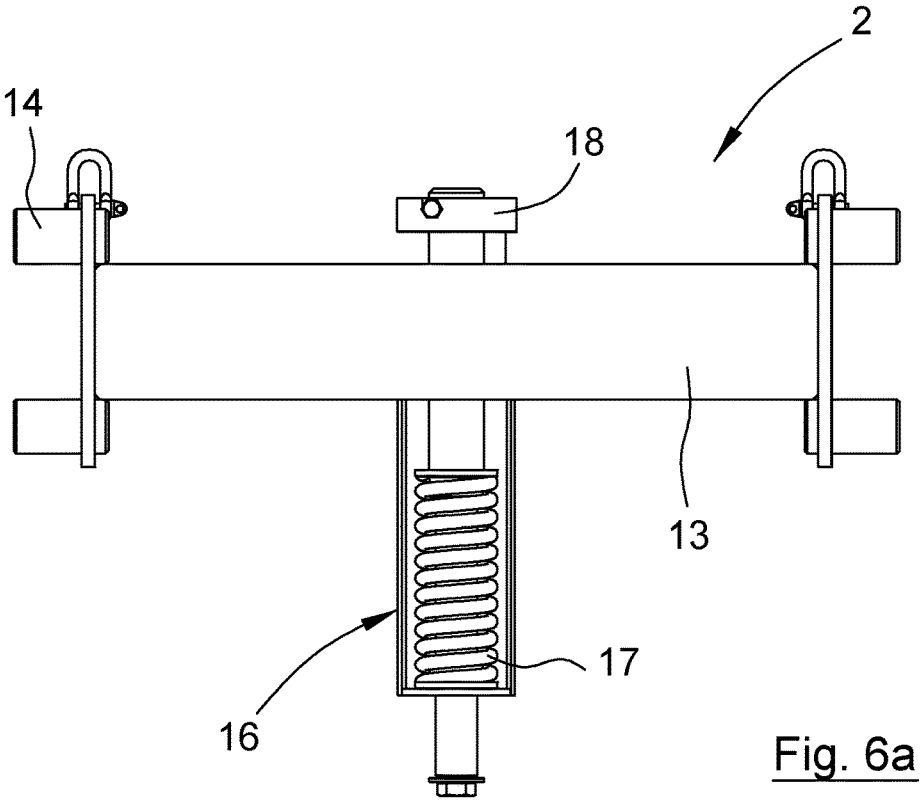
FIG. 6*a* is a schematic front view of the chain tensioning arrangement according to a second embodiment in which it is disclosed operational in accordance with FIG. 2*b*.
Figure 6B:
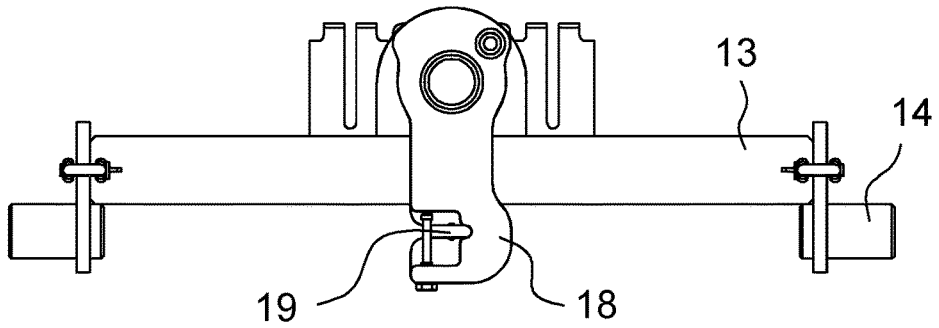
FIG. 6*b* is a schematic view from above of the chain tensioning arrangement according to the second embodiment in which it is operational in accordance with FIG. 6*a*.

Analogously to FIGS. 6*a* and 6*b* the different components of the chain tensioning arrangement 2 are disclosed from the front in FIG. 7*a* and from above in FIG. 7*b*. By comparing the spring arrangement in FIGS. 6*a* and 7*a* it is clear that the spring member 17 in FIG. 7*a* is maximally expanded. Thus, the arm 18 that is connected to the spring member 17 is located in the upper position. The spring arrangement exerts no upwardly directed force against the arm 18, which thereby can be pivoted between its active and inactive positions, respectively.

In the following and with reference to FIGS. 7*a* and 7*b* the function of the chain tensioning arrangement is described in connection with hoisting of the pump 4 from the bottom of the column pipe 3 to the top of the column pipe 3 and/or out of the column pipe 3.

The pump 4 is lifted a few centimeters whereby the arm 18 is displaced in the direction towards the upper position under the effect of the spring member 17. When the arm 18 is located in the upper position it is pivoted from the active position to the inactive position, whereupon the engagement chain link of the chain unengaged the engagement member 19 of the arm. Thereafter the pump 4 is hoisted in conventional way be lifting in the chain 6. Before the pump is removed from the column pipe 3 the chain tensioning arrangement 2 must be removed from the upper end of the column pipe 3.

Figure 8:
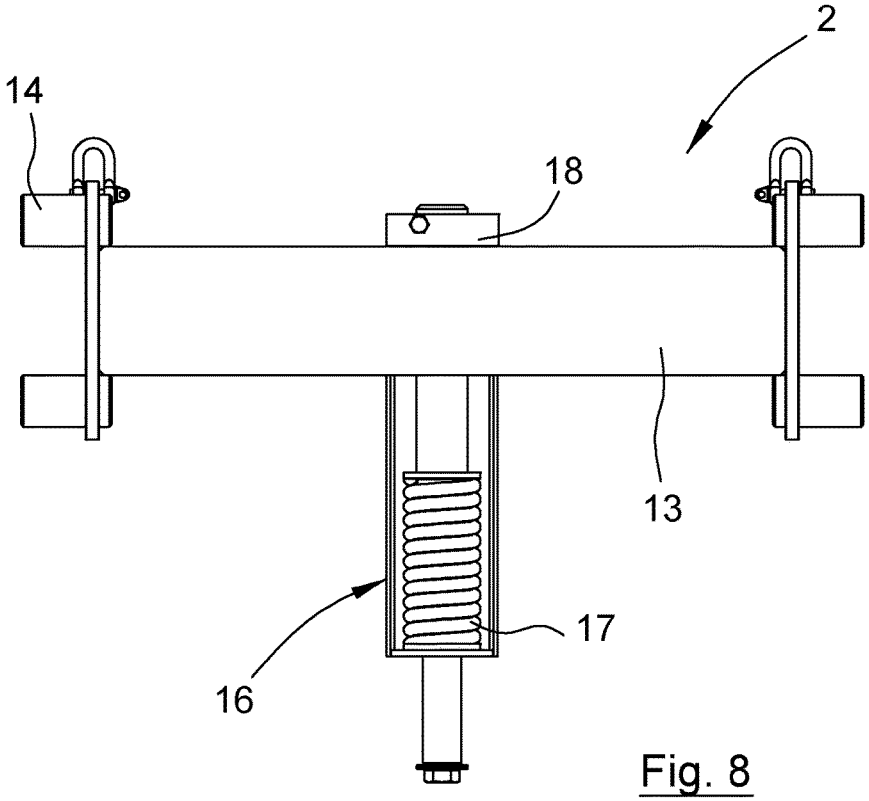
FIG. 8 is a schematic front view of the chain tensioning arrangement according to the second embodiment in which the pump is under retake corresponding to FIG. 4*b*.

Reference is now made to FIG. 8 that disclose the chain tensioning arrangement 2 during so-called retake, as is described in connection with the first embodiment of the chain tensioning arrangement. During retake the chain tensioning arrangement is used to secure and remain the pump 4 at the reached height in the column pipe 3 during the retake is carried out.

In the following the function of the chain tensioning arrangement is described in connection with retake during hoisting of the pump 4. The chain 6 is not in engagement with the arm 18, and the arm 18 is pivoted to the inactive position. The pump 4 is hoisted to a height admitted by the crane, the chain is thus tensioned since the pump 4 is hanging in the chain 6 and the chain runs centrally in the column pipe 3. The arm 18 is in the upper position and is pivoted from the inactive position towards the active position and towards the chain 6 such that the engagement member 19 engage the chain link that best match the height position of the arm 18. Thereafter, the pump 4 is lowered a few centimeters by means of the crane such that the entire weight of the pump 4 is supported by the chain tensioning arrangement 2. Thus, the arm 18 is forced to the lower position in which the arm 18 abuts the cross beam 13. Thereafter, the crane takes a new grip in the chain 6 close to the chain tensioning arrangement. The pump 4 is lifted a few centimeters such that the arm 18 is displaced to the upper position. The arm 18 is thereafter pivoted to the inactive position such that the engagement between the engagement member 19 and the chain 6 is broken. The chain tensioning arrangement 2 is removed from the column pipe 3 such that the pump 4 can be hoisted all the way up to the top of the column pipe 3 and/or out of the column pipe 3. Alternatively one or more extra retakes may be needed.

The function of the chain tensioning arrangement in connection with retake during lowering of the pump 4 is analogous to the above described procedure regarding retake during hoisting.

Thus, the pump 4 is firstly lowered as much as admitted by the crane except from at least the centimeters needed to lower the pump 4 when the arm 18 is displaced to the lower position by the weight of the pump 4. The chain 6 runs centrally in the column pipe 3 and is tensioned since it is loaded with the entire weight of the pump 4. The chain tensioning arrangement 2 is attached having the arm 18 pivoted to the inactive position as well as located in the upper position. The arm 18 is pivoted to the active position such that the engagement member 19 can engage the chain 6. The pump 4 is lowered a few centimeters by means of the crane such that the entire weight of the pump is supported by the arm 18 and the chain tensioning arrangement 2 when the arm 18 abuts the cross beam 13. The crane takes a new grip higher up on the chain and lifts the pump a few centimeters such that the arm 18 is displaced to the upper position by means of the spring member 17 and thereafter once again is pivoted to the inactive position. Thereafter, the pump 4 is lowered all the way down to the bottom of the column pipe 3 whereupon the chain 6 becomes slack. Alternatively one or more extra retakes may be needed. The rest of the procedure is constituted by a tensioning of the slack chain 6 as is already described in connection with FIGS. 6*a* and 6*b*.

Analogous to FIGS. 6*a* and 7*a* the different components of the chain tensioning arrangement are disclosed from the front in FIG. 8. By comparing the spring arrangement in FIGS. 6*a* and 7*a* it is clear that the spring arrangement in FIG. 8 is maximally compressed. This is since the pump 4 is hanging in the chain tensioning arrangement and thus the entire weight of the pump is supported by the chain tensioning arrangement. Thus, the arm 18 that is connected to the spring member of the spring arrangement is located in the lower position abutting the cross beam 13. The spring arrangement shall preferably not bottom when the arm 18 is located in the lower position.

In the following reference is made to FIG. 9*a* that is a perspective view from above of the front side of the chain tensioning arrangement according to the second embodiment as well as to FIG. 9*b* that is a perspective view from above of the back side of the chain tensioning arrangement according to the second embodiment.

Figure 9A:
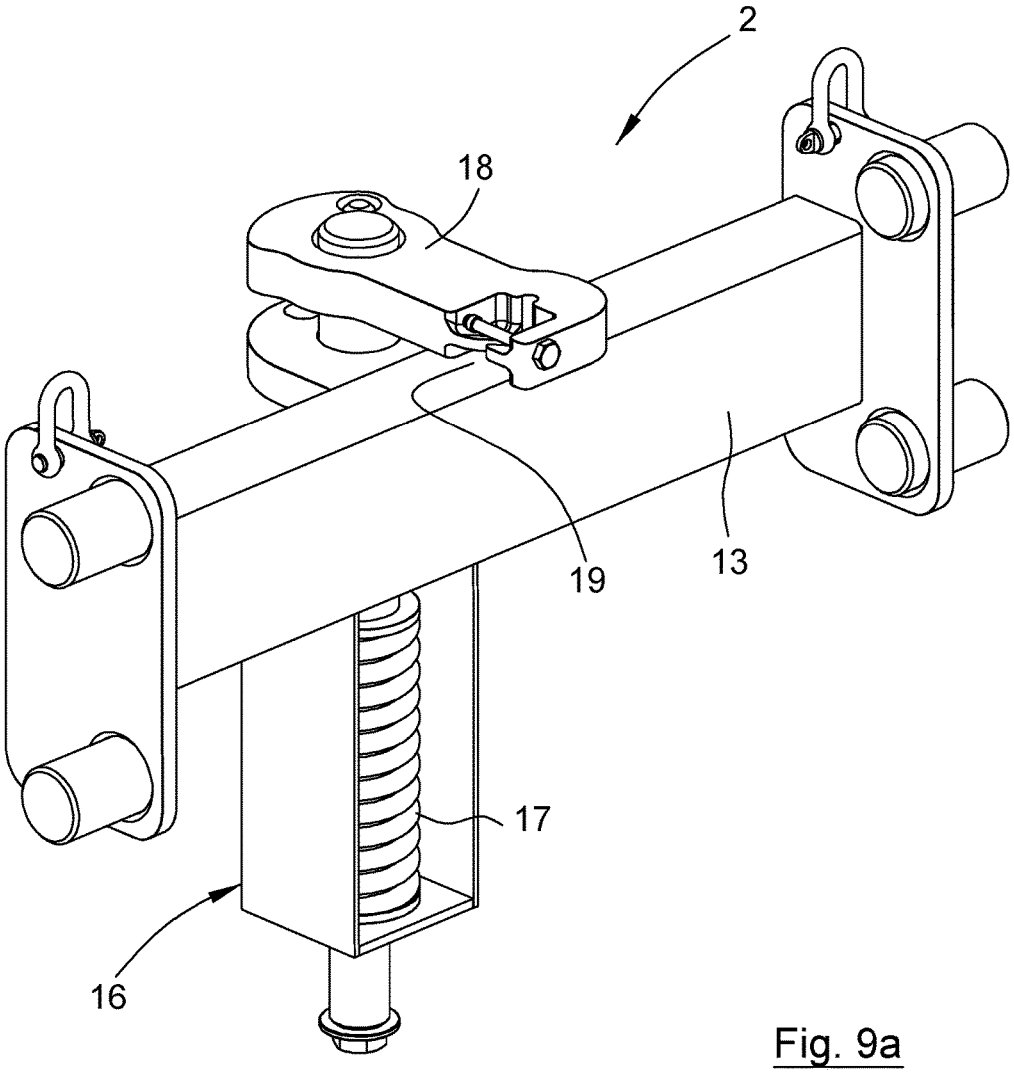
FIG. 9*a* is a perspective view from above of the front side of the chain tensioning arrangement according to the second embodiment in which it is operational in accordance with FIGS. 6*a* and 6*b*.
Figure 9B:
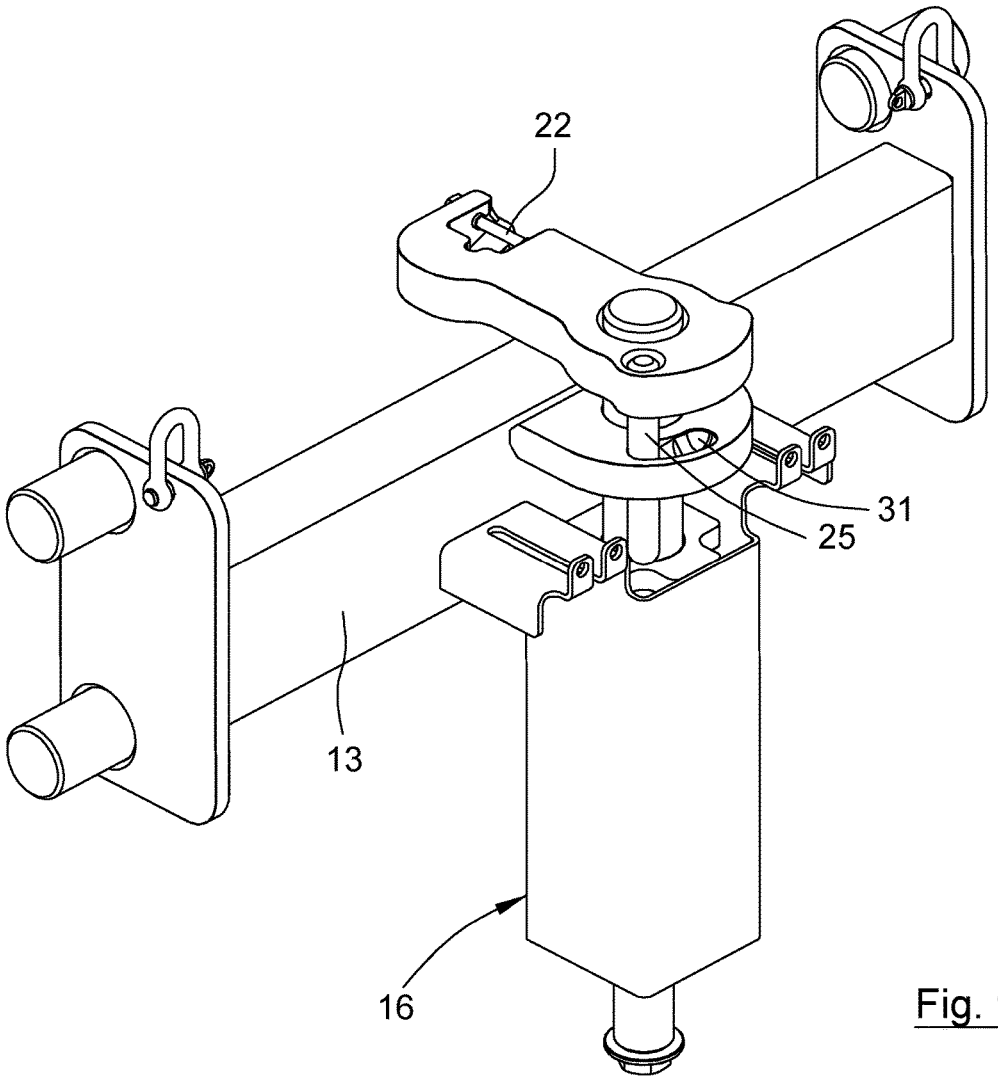
FIG. 9*b* is a perspective view from above of the back side of the chain tensioning arrangement according to the second embodiment in which it is operational in accordance with FIG. 9*a*.

FIG. 9*a* discloses the spring arrangement 16 comprising one spring member 17 that is constituted by a helical spring. In the figures the spring member 17 is partly expanded, i.e. the chain tensioning arrangement is in the position in which the pump 4 is in operation and the chain tensioning arrangement stretches the chain 6. The arm is in the active position and located between the upper and the lower position.

In its free end the arm 18 has the engagement member 19. The engagement member 19 has a seat configured to receive at least one link of the chain 6. The seat is inclined in the direction inwards/downwards in order to secure the chain in the engagement member 19. A locking pin/locking screw 22 attends to secure the received chain link in the seat even further. In the disclosed embodiment the seat is arranged perpendicular to the direction of the main extension of the arm, however, other angles are conceivable, such as parallel to the direction of the main extension of the arm.

When the arm 18 is in the active position the guide pin 25, which is fixedly connected to the arm 18, may be displaced in the axial direction at the same time as pivoting of the arm 18 from the active position to the inactive position is prevented when the arm 18 is at a distance from the upper position. When the arm 18 is in the upper position the lower end of the guide pin 25 runs in an arc-shaped chute 31, whereupon the joint action thereof delimit the pivot angle of the arm 18. It shall be pointed out that the chute 31 is not all through and thereby the arm 18 is prevented from being displaced from the upper position towards the lower position when the arm is located in the inactive position. This feature is directly applicable to the first embodiment of the chain tensioning arrangement 2.

Figure 10B:
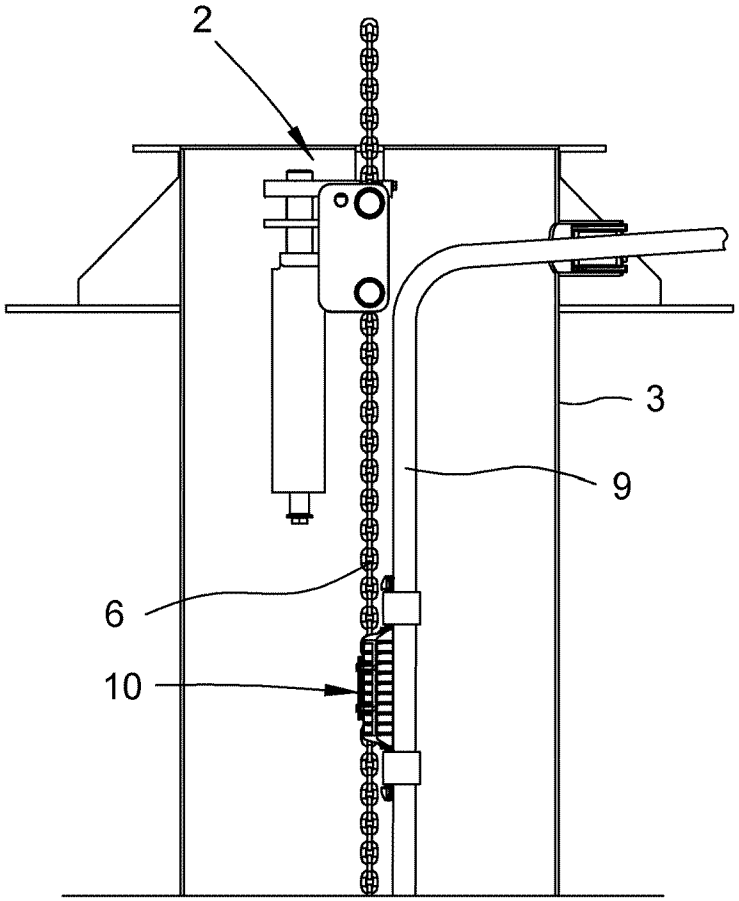
FIG. 10*b* is a schematic cut-away view from the side of the upper part of the pump station in accordance with FIG. 10*a*.
Figure 10A:
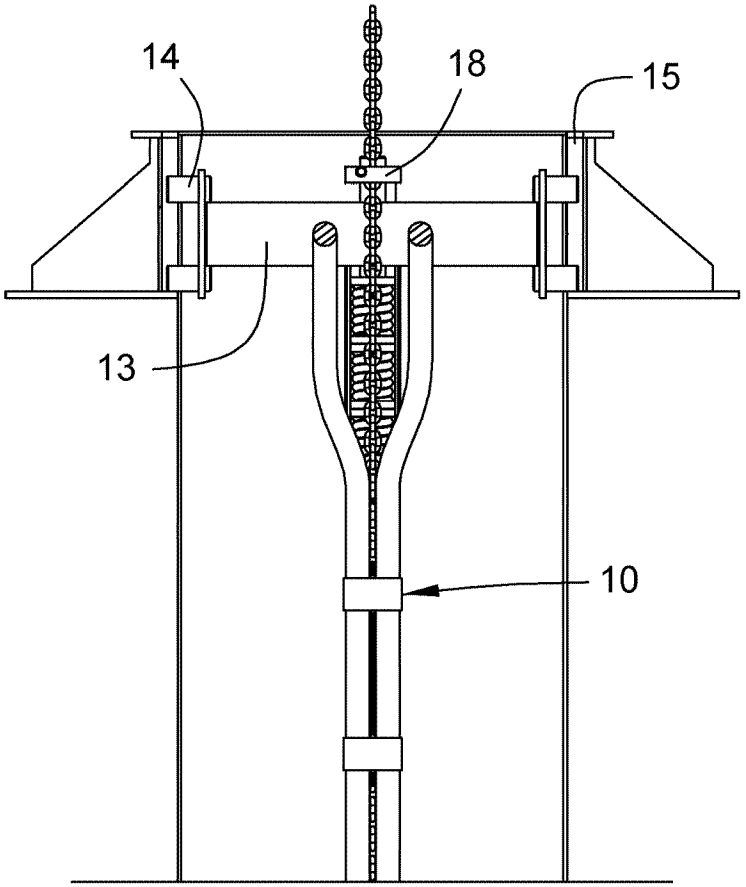
FIG. 10*a* is a schematic cut-away front view of an upper part of the pump station disclosing the chain tensioning arrangement, the chain and the electric cables of the axial pump, wherein the electric cables extend in parallel with the chain.

Reference is now made to FIGS. 10*a* and 10*b* that are a schematic cross sectional view from the front and from the side, respectively, of an upper part of the pump station 1. Both figures contextual the preferred locations and extensions of the electric cables 9 in relation to the chain tensioning arrangement 2 and the column pipe 3. It shall be pointed out that other installations/pumps can comprise only one cable and alternatively more than two electric cables. The two disclosed electric cables 9 weigh together in the range 4-8 kilograms/meter and has a diameter in the range 20-40 millimeters. The two electric cables 9 that are disclosed are connected to the stretched chain by means of a two part electric cable holder 10 as will be described in more detail with reference to FIGS. 11*a* and 11*b*. Thus, a stretched, essentially unmoving chain 6*b* open for connecting the electric cables 9 directly to the chain 6 and also removes the need for a wire such has been previously used to secure electric cables in different pump stations.

Figure 11B:
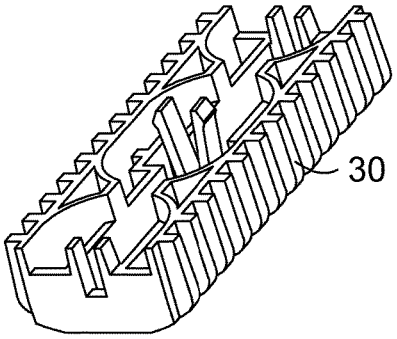
FIG. 11*b* is a schematic perspective view from above of a second member of the electric cable holder, which second member is configured to be connected to the chain.
Figure 11A:
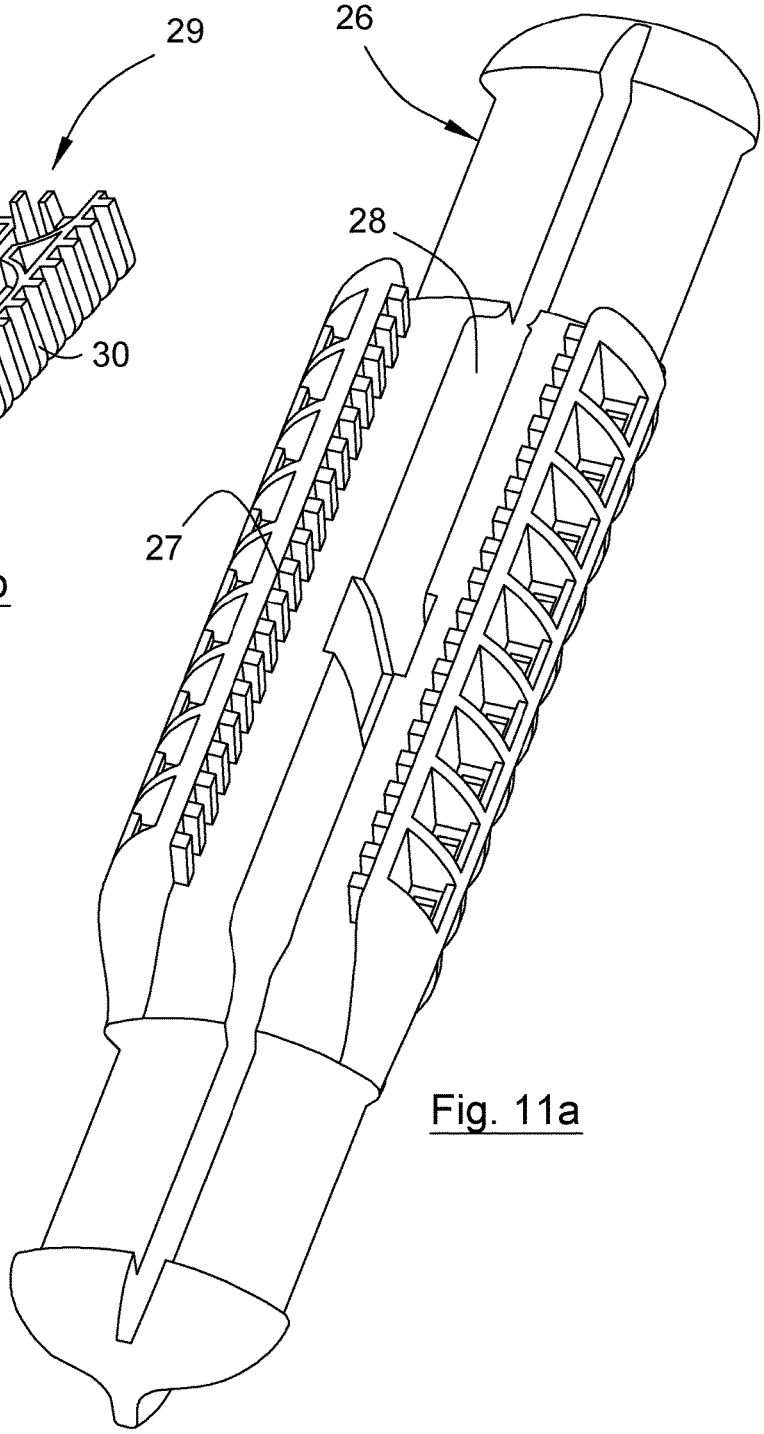
FIG. 11*a* is a schematic perspective view from above of a first member of an electric cable holder, which first member is configured to be connected to the electric cables.

FIG. 11*a* is a schematic perspective view from above of a first member 26 of the two part electric cable holder, which first member 26 is configured to be attached to the electric cables 9. Two opposite sets of block shaped projections 27 are arranged in a seat 28 at the front side of the first member 26. Thus, between each pair of adjacent projections there is a gap. A slit 28 extend essentially along the entire seat of the first member 26, between said two sets of projections 27. The split 28 is configured to receive links of the chain. The first member 26 of the electric cable holder 10 can be made in any suitable polymeric material.

FIG. 11*b* is a schematic perspective view from above of the second element 28 of the two part electric cable holder 10, which second member 29 is configured to be connected to the chain 6. More specifically the links, three whole and two half links, of the chain 6 are located in a seat of the second member 29. One whole and two half links lie flat in the seat and the other two whole links stands on its edge. This seat is designed to be able to receive and fixate the links. The chain is hereby detachably connected to the second member 29. The second member 29 comprises two opposite sets of block shaped projections 30, complementary to the gaps belonging to the two sets of opposite projections 27 of the first member 26. Also the second member 29 may be made by any suitable polymer material. In the following the procedure to connect the electric cables 9 to the chain 6 by means of the two part electric cable holder according to FIGS. 11*a* and 11*b* is described.

The respective end section of the first element 26 is pre attached, for instance by means of vulcanization tape, to the electric cables 9 approximately every meter, the distance between two neighboring first member 26 along the electric cables shall preferably not exceed 1.5 meters. At the same time as the pump 4 is lowered and the chain 6 is tensioned a second member 29 is attached to the links of the chain according to the above at a height corresponding to the first member 26 that is connected to the electric cables 9. The electric cables 9 are stretched by hand and the second member 29 is brought in engagement with the first member 26 by arranging the projections 30 of the second member between the projections 27 of the first member 26. The electric cables shall be kept as stretched as possible.

Thereafter the first member 26 and the second member 29 of the electric cable holder are secured to each other by means of a stripe or the like.

The above procedure is performed during the lowering of the pump and the chain is tensioned. During hoisting of the pump the stripes of the respective electric cable holder 10 coming out of the column pipe are cut off and the electric cables 9 are detached from the chain 6 concurrently as the pump 4 is hoisted.

Generally the electric cable holder 10 can be defined as an electric cable holder for anchorage of at least one electric cable to a chain. The electric cable holder comprises a first member 26 configured to be connected to said at least one electric cable and a second member 29 configured to be connected to said chain, the first member 26 presenting a seat 28 in which the second member 29 is detachably received, said second member 29 being configured to in the seat 28 optionally take one of at least two, mutually and in relation to the first member 26, axially separated positions.

Feasible Modifications of the Invention

The invention is not limited only to the embodiments described above and shown in the drawings, which primarily have an illustrative and exemplifying purpose. This patent application is intended to cover all adjustments and variants of the preferred embodiments described herein, thus the present invention is defined by the wording of the appended claims and the equivalents thereof. Thus, the equipment may be modified in all kinds of ways within the scope of the appended claims.

For instance the arm can be of fixed type, e.g. nonepivotable, and arranged perpendicular to the cross beam and rigidly connected thereto. The outer most part of the free end of the arm is then constituted by an engagement member configured to engage one of the links of the chain.

It shall also be pointed out that all information about/concerning terms such as above, under, upper, lower, etc., shall be interpreted/read having the equipment oriented according to the figures, having the drawings oriented such that the references can be properly read. Thus, such terms only indicates mutual relations in the shown embodiments, which relations may be changed if the inventive equipment is provided with another structure/design.

It shall also be pointed out that even thus it is not explicitly stated that features from a specific embodiment may be combined with features from another embodiment, the combination shall be considered obvious, if the combination is possible.

The invention claimed is:

1. A chain tensioning arrangement for an axially extending column pipe which is configured to house a submersible pump, the chain tensioning arrangement comprising:

a cross beam configured to extend in a radial direction in relation to the column pipe, a spring arrangement including at least one spring member connected to the cross beam, and an arm that is movably connected to the cross beam via the spring arrangement and that includes an engagement member configured to selectively engage a chain connected to said pump, wherein the arm has a main extension configured to extend in the radial direction in relation to the column pipe, the arm being displaceable in an axial direction between a lower position and an upper position, wherein the arm is pivotable in a radially extending plane between an active position, in which the arm is engaged with the chain, and an inactive position, in which the arm is disengaged from the chain, said at least one spring member being arranged to displace the arm from the lower position towards the upper position.

2. The chain tensioning arrangement according to claim 1, further comprising means for limiting displacement of the arm in the axial direction between the lower position and the upper position.

3. The chain tensioning arrangement according to claim 2, wherein the means for limiting displacement is a screw.

4. The chain tensioning arrangement according to claim 2, wherein the means for limiting displacement is a lower end of the at least one spring member that is adjustable in the axial direction for limiting displacement of the arm in the axial direction between the lower position and the upper position.

5. The chain tensioning arrangement according to claim 1, wherein the cross beam extends in parallel with the radially extending plane in which the arm is configured to pivot.

6. The chain tensioning arrangement according to claim 1, wherein said at least one spring member is a helical spring.

7. The chain tensioning arrangement according to claim 1, wherein the arm is either directly or indirectly connected to the at least one spring member.

8. The chain tensioning arrangement according to claim 1, wherein said at least one spring member exerts no upwardly directed force against the arm when the arm is located in the upper position thereof.

9. The chain tensioning arrangement according to claim 1, wherein respective opposite ends of the cross beam each comprises at least one pin configured to be releasably connected to the column pipe.

10. The chain tensioning arrangement according to claim 1, wherein the cross beam has a main extension configured to extend in a horizontal direction.

11. The chain tensioning arrangement according to claim 1, wherein the engagement member of the arm is constituted by a seat configured to receive at least one link of the chain.

12. The chain tensioning arrangement according to claim 1, further comprising an axially extending guide pin configured to interact with said arm.

13. The chain tensioning arrangement of claim 1, wherein the arm includes an opening through which the chain is removed from the arm as the arm pivots between the active position and the inactive position.

14. A pump station comprising an axially extending column pipe, a submersible pump arranged in the column pipe, a chain tensioning arrangement including a cross beam extending in a radial direction in relation to the column pipe, and an axially extending chain connected to the pump and configured to move the pump in the column pipe, wherein the chain tensioning arrangement of the pump station comprises:

a spring arrangement including at least one spring member connected to the cross beam, and an arm that is movably connected to the cross beam via the spring arrangement and that includes an engagement member configured to selectively engage the axially extending chain, wherein the arm is pivotable in a radially extending plane between an active position, in which the arm is engaged with the chain, and an inactive position, in which the arm is disengaged from the chain, wherein the arm has a main extension extending in the radial direction in relation to the column pipe, the arm being displaceable in an axial direction between a lower position and an upper position, said at least one spring member being arranged to displace the arm in a direction from the lower position towards the upper position.

15. The pump station of claim 14, wherein the arm includes an opening through which the chain is removed from the arm as the arm pivots between the active position and the inactive position.

* * * * *